US010722002B2

(12) United States Patent
Harms et al.

(10) Patent No.: US 10,722,002 B2
(45) Date of Patent: Jul. 28, 2020

(54) ILLUMINATED BELT BUCKLE FOR A SEAT BELT DEVICE OF A MOTOR VEHICLE

(71) Applicant: AUTOLIV DEVELOPMENT AB, Vargarda (SE)

(72) Inventors: Fabian Harms, Hamburg (DE); Arndt Sohnchen, Hamburg (DE); Iulian Rotariu, Elmshorn (DE)

(73) Assignee: AUTOLIV DEVELOPMENT AB, Vargarda (SE)

( * ) Notice: Subject to any disclaimer, the term of this patent is extended or adjusted under 35 U.S.C. 154(b) by 0 days.

(21) Appl. No.: 16/087,237

(22) PCT Filed: Mar. 20, 2017

(86) PCT No.: PCT/EP2017/056509
§ 371 (c)(1),
(2) Date: Sep. 21, 2018

(87) PCT Pub. No.: WO2017/162558
PCT Pub. Date: Sep. 28, 2017

(65) Prior Publication Data

US 2019/0059521 A1 Feb. 28, 2019

(30) Foreign Application Priority Data

Mar. 24, 2016 (DE) ..... 10 2016 204 961

(51) Int. Cl.
*A44B 11/25* (2006.01)

(52) U.S. Cl.
CPC ..... *A44B 11/2565* (2013.01); *A44B 11/2523* (2013.01)

(58) Field of Classification Search
CPC ..... A44B 11/2565; B60Q 3/62; B60Q 3/20
See application file for complete search history.

(56) References Cited

U.S. PATENT DOCUMENTS 4,237,586 A 12/1980 Morinaga
4,933,818 A 6/1990 Eckmann
(Continued)

FOREIGN PATENT DOCUMENTS

DE 39 04 125 A1 8/1989
DE 91 05 784 U1 9/1991
(Continued)

OTHER PUBLICATIONS

International Search Report of PCT/EP2017/056509 dated May 17, 2017.

*Primary Examiner* — Robert Sandy
*Assistant Examiner* — Michael S Lee
(74) *Attorney, Agent, or Firm* — Dickinson Wright PLLC

(57) ABSTRACT

An illuminated belt buckle (1) for a seat belt device of a motor vehicle, having a housing (2), a push button (3) displaceable in the housing (2), an insertion slot (4) bounded by an edge section (21) of the housing (2). A light source (10) and the at least one light emission surface (12, 13, 38, 39) are connected via at least one optical waveguide (11), and wherein a deflecting element (14, 15, 16) is arranged or formed on at least one boundary surface (7) of the optical waveguide (11) and/or on at least one boundary surface (8, 9) of the light emission surface (12, 13, 38, 39). The deflecting element having a geometry that differs from the rest of the boundary surface (7, 8, 9).

18 Claims, 9 Drawing Sheets

(56) References Cited

U.S. PATENT DOCUMENTS

| | | | | |
|---|---|---|---|---|
| 5,176,439 | A | 1/1993 | Kawamura | |
| 5,892,436 | A * | 4/1999 | Blackburn | A44B 11/2565 180/268 |
| 9,151,485 | B2 | 10/2015 | Woodham | |
| 10,383,406 | B2 * | 8/2019 | Sohnchen | A44B 11/2565 |
| 2014/0239853 | A1 | 8/2014 | Woodham | |
| 2014/0268844 | A1 * | 9/2014 | Knoedl | A44B 11/2565 362/488 |
| 2016/0031367 | A1 * | 2/2016 | Salter | G02B 6/0096 362/583 |
| 2017/0001557 | A1 * | 1/2017 | Fujii | A44B 11/2565 |
| 2017/0127765 | A1 | 5/2017 | Betz et al. | |
| 2017/0280830 | A1 | 10/2017 | Effenberger | |
| 2018/0192744 | A1 * | 7/2018 | Sohnchen | A44B 11/2565 |

FOREIGN PATENT DOCUMENTS

| | | | |
|---|---|---|---|
| DE | 41 15 318 | A1 | 11/1991 |
| DE | 10 2007 047 704 | A1 | 4/2009 |
| DE | 10 2014 016 520 | A1 | 5/2016 |
| DE | 10 2015 206 602 | A1 | 6/2016 |
| EP | 1 731 051 | A1 | 12/2006 |
| EP | 1 898 147 | A1 | 3/2008 |
| WO | WO 2016/008585 | A1 | 1/2016 |

* cited by examiner

ILLUMINATED BELT BUCKLE FOR A SEAT BELT DEVICE OF A MOTOR VEHICLE

CROSS-REFERENCE TO RELATED APPLICATIONS

This application is a 35 U.S.C. § 371 national phase application of PCT International Application No. PCT/EP2017/056509, filed Mar. 20, 2017, which claims the benefit of priority under 35 U.S.C. § 119 to German Patent Application No. 10 2016 204 961.5, filed Mar. 24, 2016, the contents of which are incorporated herein by reference in their entirety.

FIELD OF THE INVENTION

The present invention relates to an illuminated belt buckle for a seat belt device of a motor vehicle.

BACKGROUND

Belt buckles for seat belt devices of motor vehicles are generally used to firmly lock a belt latch that is slidably guided on a belt strap or fixedly connected to one end of a belt strap. For this purpose, the belt buckle has an insertion slot for the belt latch and a locking mechanism that can be released via a push button. The locking mechanism is spring-loaded and automatically locks the belt latch on insertion into the insertion slot. To release the belt latch, the occupant pushes down on the push button, thereby releasing the locking mechanism and ejecting the belt latch due to the released spring force of the locking mechanism.

Such belt buckles have long been found in the prior art. One problem of such belt buckles is that the occupant, in order to fasten the belt, needs to find the relatively narrow insertion slot of the belt buckle, into which they will insert the belt latch in order to fasten the seat belt.

DE 39 04 125 A1 discloses providing, on the belt buckle, a light source that is coupled via a light-guiding material to predetermined light emission surfaces of the belt buckle. The light emission surfaces are here the push button itself and an emission surface arranged on a side surface of the insertion slot lying opposite the push button. Because the push button needs to be configured so as to be displaceable in order to function, the light-guiding material fixedly arranged in the push button must be positioned in the push button in such a manner that the light entry surface of the light-guiding material is optically connected to the external light source when the push button is in the non-depressed position. If the light entry surface of the light-guiding material, when in this position, is not optically connected to the external light source due to production-related shape deviations or mechanical influences, then the light either is not passed or only incompletely passed to the push button, so that the push button is not even illuminated, or is illuminated less intensely than was desired.

DE 10 2007 047 704 A1 also discloses providing, in the belt buckle, an optical waveguide having at least two light emission surfaces that are arranged at the ends of the insertion slot. The light emission surfaces themselves are triangle-shaped and are arranged in a free, triangle-shaped surface on the end face of the housing, between the edge of the housing and a conical side surface of the push button. The light emission surfaces are then, in particular, dimensioned so as to fill the free surfaces in the corners of the end face of the housing over as large an area as possible, in order to achieve maximum luminosity.

The present invention addresses the problem of providing an illuminated belt buckle of the generic type, which achieves an especially efficient and uniform illumination of the light emission surface.

An illuminated belt buckle having the features as described herein is proposed as a solution to the problem. Other preferred embodiments of the invention can be found in the drawings, and the accompanying description.

SUMMARY AND INTRODUCTORY DESCRIPTION

According to the feature of embodiments of the invention, it is proposed that a deflecting element be arranged on at least one boundary surface of the optical waveguide and/or on at least one boundary surface of the light emission surface, the deflecting element having a geometry that differs from the rest of the boundary surface.

The advantage of the proposed solution can be found in making it easier to find the belt buckle and, in particular, the push button and the insertion slot, thus making it possible to, without difficulty, insert a belt latch in order to attach the seat belt or to press even in limited lighting conditions or darkness in the motor vehicle. The occupant can thus find the push button, if necessary, after repeated efforts and the associated effect of acquiring knowledge of the location of the light emission surfaces relative to the push button entirely by the shape and location of the light emission surface. Because the insertion slot is arranged in a fixed orientation relative to the push button, it is also easier to find the insertion slot when the seat belt is being attached. The deflecting elements achieve an especially uniform illumination of the light emission surface, because the light guided through the optical waveguide can be deflected and scattered accordingly, thus making it possible to find the push button and the insertion slot without difficulty even when parts of the light emission surface are covered, for example, by the occupants' clothing. Uniform illumination of the belt buckle also causes the belt buckle to act in a qualitatively higher-quality manner.

According to a preferred embodiment, it is proposed that the deflecting element protrudes out relative to the rest of the boundary surface, or be recessed relative to the rest of the boundary surface. This makes it simple to configure a deflecting element that has an altered behavior of reflection relative to the rest of the boundary surface of the optical waveguide. The brightness can thus be increased in otherwise dimly-lit regions, or reduced in otherwise especially brightly-lit regions.

It is provided as an advantageous alternative or addition that the deflecting element be arranged or formed at an angle that differs from the rest of the boundary surface. The deflecting element may both be installed as an additional component on the wall of the optical waveguide that constitutes a boundary surface, and be formed integrally, in particular, as a single piece with this boundary surface. The boundary surface then has a shape that differs from the cylindrical shape substantially found in optical waveguides. This makes it possible to vary the light intensity, so that partial regions of the light emission surface that would otherwise, without deflecting elements, be especially poorly lit can be better lit.

In a preferred embodiment of the invention, a plurality of deflecting elements are present on at least one of the boundary surfaces. Having a plurality of deflecting elements on the boundary surfaces makes it possible to deflect a plurality of light beams in the same direction, thus providing the ability to further enhance the aforementioned effect of better lighting.

It is then preferred to combine a plurality of identical or similar deflecting elements in a cluster. "Similar" deflecting elements are understood in this context to signify deflecting elements that have the same basic form, but differ from one another, for example, in size and/or orientation. Such a cluster makes it possible to specifically illuminate one region, so that this region can be additionally illuminated.

It is especially advantageous when a plurality of clusters of deflecting elements are present on the boundary surfaces. Having a plurality of clusters enables multiple deflections of light beams, wherein preferably at least two clusters are arranged relative to one another in such a manner that a plurality of light beams guided through the optical waveguide are deflected at a first cluster and aligned at a second cluster. This makes it possible to specifically concentrate light beams onto the deflecting elements of the second cluster, which may have, for example, a specific scattering geometry and can thus provide for especially uniform illumination of the belt buckle.

According to a preferred embodiment of the invention, it is provided that the deflecting elements are wedge-shaped or stair-shaped. Having a wedge shape or stair shape makes it possible to constitute the boundary surface with a slight angle relative to the rest of the boundary surface of the optical waveguide. So doing provides the ability to alter the angle of reflection at the rest of the boundary surface, and thus deflect an incident light beam. In addition, wedge-shaped or stair-shaped deflecting elements are easy, in terms of manufacturing, to form on the boundary surfaces of the optical waveguide and can thus be presented with little extra cost.

According to another advantageous embodiment, it is provided that the deflecting elements are formed as partially circular elevations. Having a partially circular shape enables especially favorable scattering of the light, which is why the partially circular elevations are provided, in particular, as deflecting elements on the light emission surface.

According to an advantageous embodiment of the belt buckle, it is provided that the light emission surface has a linear contour, the shape of which is adapted to the shaping of an edge side of the push button that is arranged laterally in a direction of view toward the insertion slot. It is easier to press the push button because of the fact that the belt buckle has, in both the buckled normal position and the non-loaded or non-buckled position, a basic orientation in which the belt buckle is always arranged on the same side of the light emission surface. Because the insertion slot, in turn, is always arranged in a fixed orientation relative to the push button, this makes it easier to find same for the buckling process.

In a preferred embodiment, the illuminated belt buckle has, provided thereto, two light emission surfaces that are arranged at different, opposite edge sides of the push button. The push button is thereby framed on both sides by the two light emission surfaces, so that the position of the push button between the light emission surfaces is unambiguously defined and is thus especially easy to find when the light emission surfaces are lit. So doing does not require that the push button itself be visible, but only that the occupant push a finger onto the surface located between the lit light emission surfaces, in order to release the belt latch and begin the unbuckling process.

For some use cases, it is advantageous when the optical waveguide includes a light entry surface associated with the light source and two separate light emission surfaces, wherein the optical waveguide branches out from the light entry surface into two separate branches, wherein each one of the light emission surfaces is associated with one of the branches. This makes it possible to arrange the light source at a greater distance from the light exit surface. The proposed solution causes the light that has been coupled in into the optical waveguide to be divided into two light exit surfaces, and, therefrom, coupled in into the two optical waveguide bodies. The optical waveguide thus practically forms a branching of the luminous flux emitted by the light source. This makes it possible to use a single light source to illuminate both of the light emission surfaces. The optical waveguide then branches out from the light entry surface into two separate branches, wherein each one of the light exit surfaces is associated with one of the branches. The branches of the optical waveguide are used to separately guide the two luminous fluxes, having been separated from one another after the branching, to the light entry surfaces of the optical waveguide. The branches of the optical waveguide can then have any shape, and, due to a flexible configuration of the optical waveguide, can be laid in any manner in the belt buckle, depending on the available space conditions.

It is provided as an advantageous alternative that the light emission surface is configured as a band that continuously surrounds the push button. This makes it especially easy to use the push button during the unbuckling process, because the occupant can find the push button especially well due to the need merely to press on a point within the surface delimited by the continuously surrounding band.

According to an advantageous embodiment, the push button is arranged in an end surface of the housing of the illuminated belt buckle, wherein the optical waveguide has geometric interference at the side thereof that faces away from the end surface. Geometric interference is provided on the optical waveguide at the side thereof that faces away from the end surface in order to achieve uniform illumination from the light emission surface. This geometric interference may include a large number of identical or similar structures that, due to the orientation thereof, reflect the light in the direction of the light emission surface.

BRIEF DESCRIPTION OF THE DRAWINGS

The invention shall be described with preferred embodiments with reference to the accompanying drawings. In the drawings.

DETAILED DESCRIPTION

Figure 1:
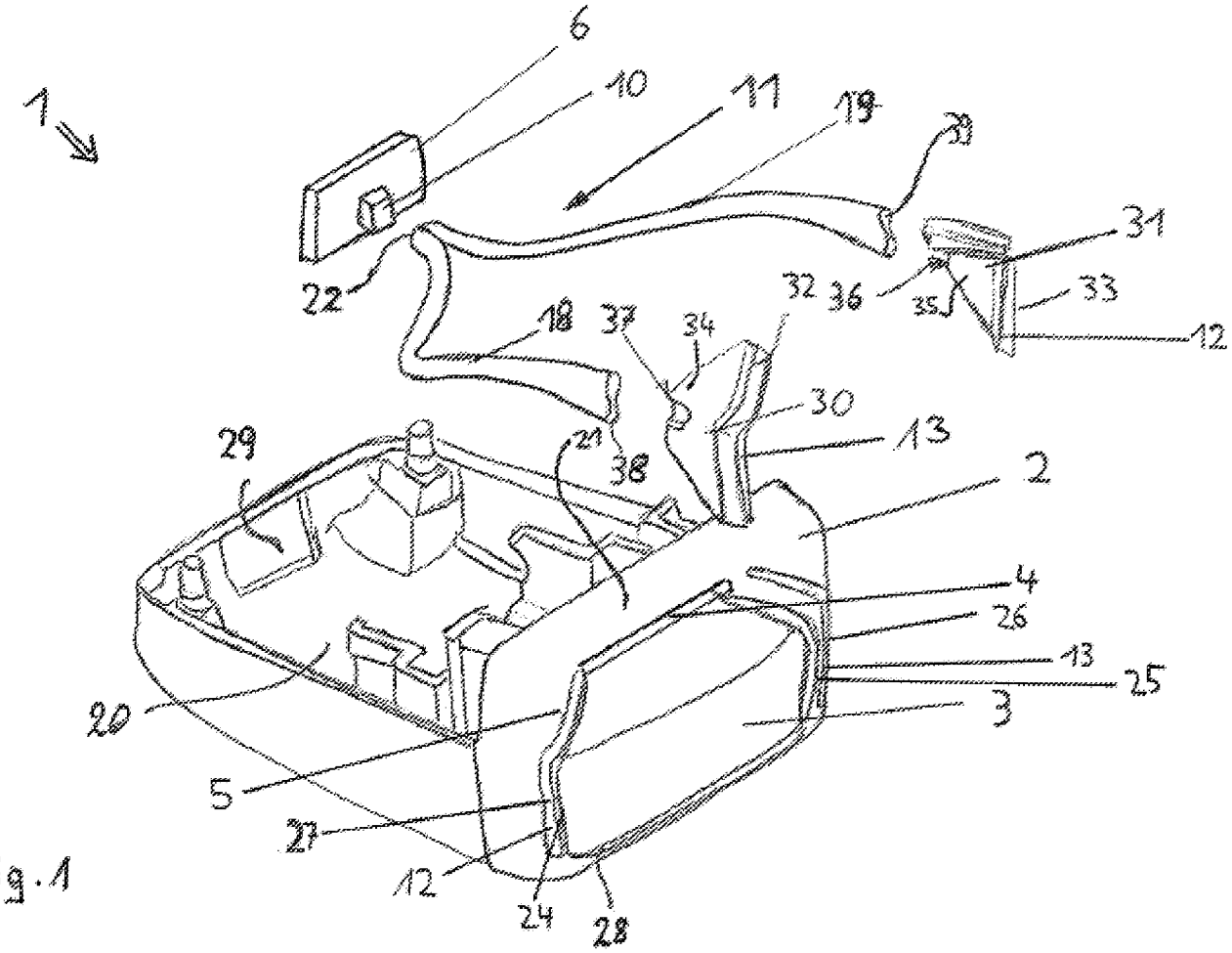
FIG. 1 illustrates a housing of an illuminated belt buckle having a two-branched optical waveguide and two light emission surfaces.

FIG. 1 shows a half of a housing 2 of an illuminated belt buckle 1 of a seat belt device for a vehicle. Provided in the housing 2 is a push button 3 that is slidably guided in the housing 2 and can be accessed through an opening 28 at the end face 5 of the housing 2. Also provided in the housing 2 is a locking mechanism (not shown, for the sake of better clarity), which can be released by depressing the push button 3 or by pushing the push button 3 into the housing 2. The visible half of the housing 2 is complemented after the locking mechanism has been installed by a second half (not shown), so that the locking mechanism is covered on all sides by the housing 2.

The push button 3 and the opening 28 of the housing 2 are dimensioned such that between the push button 3 and an edge section 21 of the housing 2, there is an insertion slot 4 into which a belt latch of the seat belt device can be inserted in order to lock in the locking mechanism of the belt buckle. The insertion slot 4 is thus laterally delimited by the push button 3 on one side and by the edge section 21 of the housing 2 on the other side, as can also be seen in FIGS. 2 and 3. The length L of the insertion slot 4 is dimensioned so as to be shorter than the width B of the push button 3 in the direction of the longitudinal direction of the insertion slot 4, wherein the insertion slot 4 is arranged approximately centrally relative to the push button 3, so that the push button 3 projects in both directions beyond the insertion slot 4 in the longitudinal direction. Provided in the housing 2, on the side of the push button 3, are two slots 26 and 27 that have a profile adapted to the profile of the adjoining edge sides 24 and 25 of the push button 3. The shape of the opening 28 in the housing 2 corresponds at least approximately to the cross-sectional shape of the push button 3, so that the slots 26 and 27 also run parallel to the edges of the housing 2 that form the opening 28. The side of the half of the housing 2 that faces away from the opening 28 also has provided thereon a recess 29 which is open on one side and in which a support plate 6 having a light source 10 fastened thereon, in the form of an LED, can be fastened. In addition to the light source 10, it is also possible to additionally provide, on the support plate 6, various storage and processing modules for controlling the light source 10 and/or processing other signals, e.g., of a belt buckle switch. There would then be provided, in particular, a module for color changes, wherein the illuminated belt buckle 1 is lit red by the module for color changes when the belt latch has not been inserted into the insertion slot 4, and, once the belt latch has been inserted, is lit white, green, or color other than red to match the interior lighting or dashboard lighting of the motor vehicle.

An optical waveguide 11 and two light emission elements 30 and 31 are also provided in the housing 2. The light emission elements 30 and 31 are made of a dimensionally stable, transparent plastic, e.g., polycarbonate or PMMA, that has light-conducting properties, and each have a fixing section 32, 33 and a coupling-in section 34, 35. The fixing sections 32, 33 are configured in terms of the cross-sectional shape so as to correspond to the shaping of the slots 26 and 27, so that the light emission elements 30 and 31 with the fixing sections 32 and 33 can each be inserted into one of the slots 26 and 27 from the inner side of the housing 2. Alternatively, however, the light emission elements 30 and 31 may also be injection-molded in a two-component injection molding process from the plastic of the housing 2. The light emission elements 30 and 31 then have, in the transition from the fixing sections 32 and 33 to the coupling-in sections 34 and 35, a step that delimits the insertion depth of the light emission elements 30 and 31 having the fixing sections 32 and 33 into the slots 26 and 27. The insertion depth of the fixing sections 32 and 33 delimited by the step is then dimensioned in such a manner that the end faces of the fixing sections 32 and 33 form a homogeneous, stepless surface outwardly when in the fastened position to the adjoining surface, in particular, to the end face 5 of the housing 2. The outer sides of the coupling-in sections 34 and 35 of the light emission elements 30 and 31 are also shaped so that the light emission elements 30 and 31 abut laterally against the inner wall of the housing 2 when in the fastened position and are thereby additionally fixed. The fixing sections 32 and 33 are shaped in the cross-section so as to completely and gaplessly fill the slots 26 and 27. The light emission elements 30 and 31 are provided with light entry surfaces 36 and 37 at the end faces of the coupling-in sections 34 and 35, and with light emission surfaces 12 and 13 at the end faces of the fixing sections 32 and 33.

The optical waveguide 11 furthermore includes a light entry surface 22 that lies opposite the light source 10 when in the fastened position of the optical waveguide 11, so that the light emitted from the light source 10 enters into the optical waveguide 11. From the light entry surface 22, the light emitted by the light source 10 is first passed on in an initial section of the optical waveguide 11 to a branching point at which the optical waveguide 11 branches into two branches 18 and 19. The light is then, in the branches 18 and 19, passed further to light emission surfaces 38 and 39, respectively, at the end faces of the branches 18 and 19. The branches 18 and 19 are so dimensioned and inherently flexible that same can be laid in the cavity 20 of the housing 2 in a curved profile according to the available installation space conditions. The branches 18 and 19 are then so dimensioned in length and so laid that the light emission surfaces 38 and 39 at the end faces of the branches 18 and 19 lie opposite the light entry surfaces 36 and 37 of the coupling-in sections 34 and 35. The light emitted by the light source 10 is then first passed through the light entry surface 22 into the optical waveguide 11, then further passed through the branches 18 and 19 to the light emission surfaces 38 and 39. From the light emission surfaces 38 and 39, the light is passed through the light entry surface 36 and 37 into the light emission elements 30 and 31, and ultimately emitted via the light emission surfaces 12 and 13 of the fixing sections 32 and 33. The light entry surfaces 22, 36, and 37, the light emission surfaces 38 and 39, and the light emission surfaces 12 and 13 may be formed of surfaces that have been roughened by an appropriate surface treatment, which may be brought about, e.g., by chemical burning or mechanical processing. The proposed solution for using a central light source 10, an optical waveguide 11, and the two light emission elements 30 and 31 is advantageous in that the light source 10 can be arranged with the support plate 6 at a place that is favorable for mounting and contacting, and in that the light can be guided through the optical waveguide 11 and the light emission elements 30 and 31 to a predetermined place and emitted there. This makes it possible to choose the placement of the light source 10 and the location of the light emission surfaces 12 and 13 practically independently of one another. Alternatively, however, the light emission surfaces 12 and 13 may also be formed of self-illuminating, electrically activatable films, or of gas-filled light sources.

The light emission surfaces 12 and 13 are configured so as to have a linear shape, and have a profile adapted to the adjoining edge sides 24 and 25 of the push button 3. The light emission surfaces 12 and 13 also extend to the ends of the insertion slot 4 and enclose the insertion slot 4 therebetween. The light emission surfaces 12 and 13 and the insertion slot 4 thus practically form a line that covers the push button 3 on three sides. The light emission surfaces 12 and 13 then preferably have a width identical to or smaller than that of the insertion slot 4, so that the occupant hits the insertion slot 4 with the belt latch whenever they position the belt latch with the end face over a position connecting the light emission surfaces 12 and 13 to one another and then moves same in the direction of the belt buckle. The light emission surfaces 12 and 13 also encompass the end surface located in the opening 28 of the housing 2, through the push button 3, so that it is very easy for the occupant to find the push button 3, even in darkness, by pushing on the surface between the light emission surfaces 12 and 13.

Figure 2:
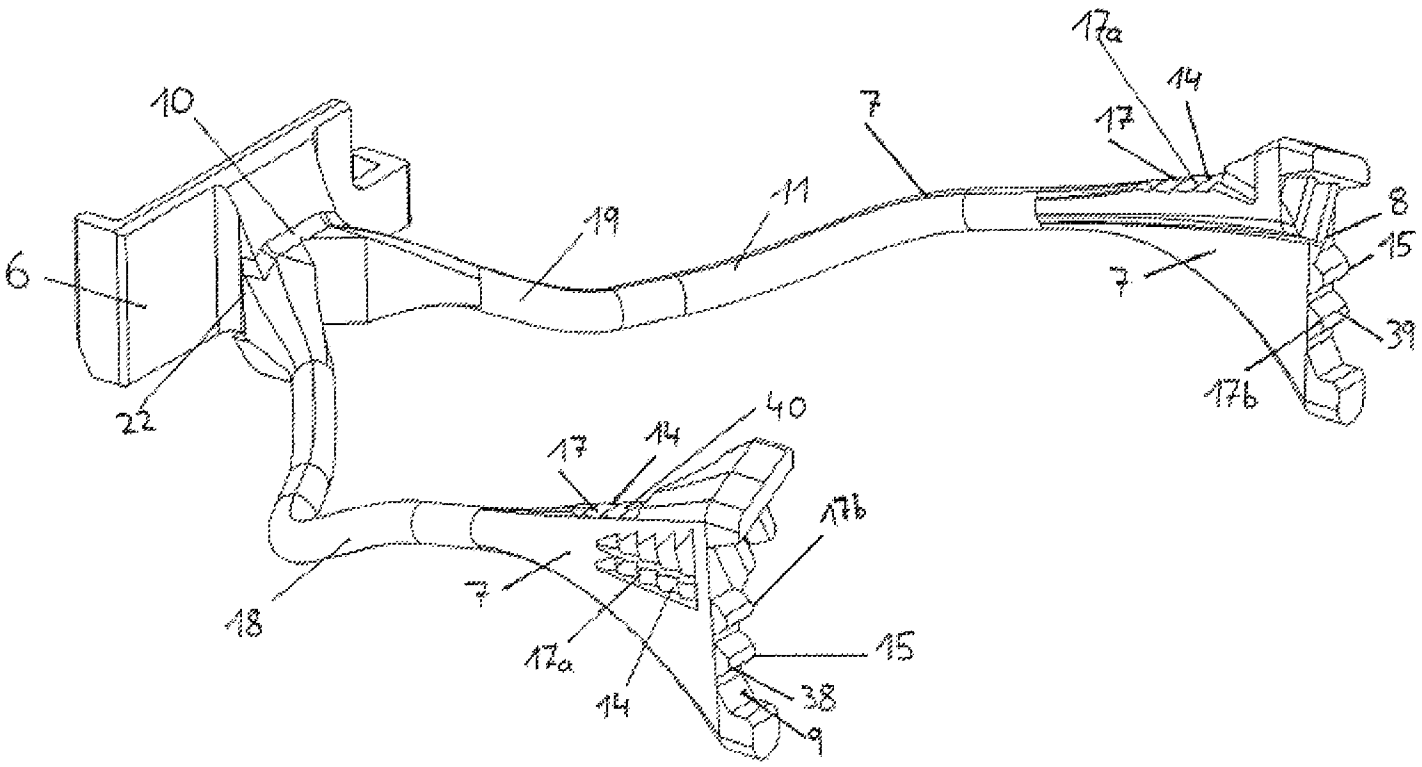
FIG. 2 illustrates an optical waveguide of an illuminated belt buckle according to the invention.

FIG. 2 depicts the optical waveguide 11 of an illuminated belt buckle 1 according to the invention. The optical waveguide 11 includes a light entry surface 22 that is coupled to a light source 10 arranged on a support plate 6. The optical waveguide 11 branches from the light entry surface 22 in the manner of antlers into two branches 18 and 19, thus making it possible to supply two light emission surfaces 38 and 39. It is alternatively possible to have another branching of the optical waveguide into more than two branches, in particular, into three or four branches, it being then provided that the branches 18 and 19 each branch once more, and thus form, altogether, four branches having four light emission surfaces.

Figure 6:
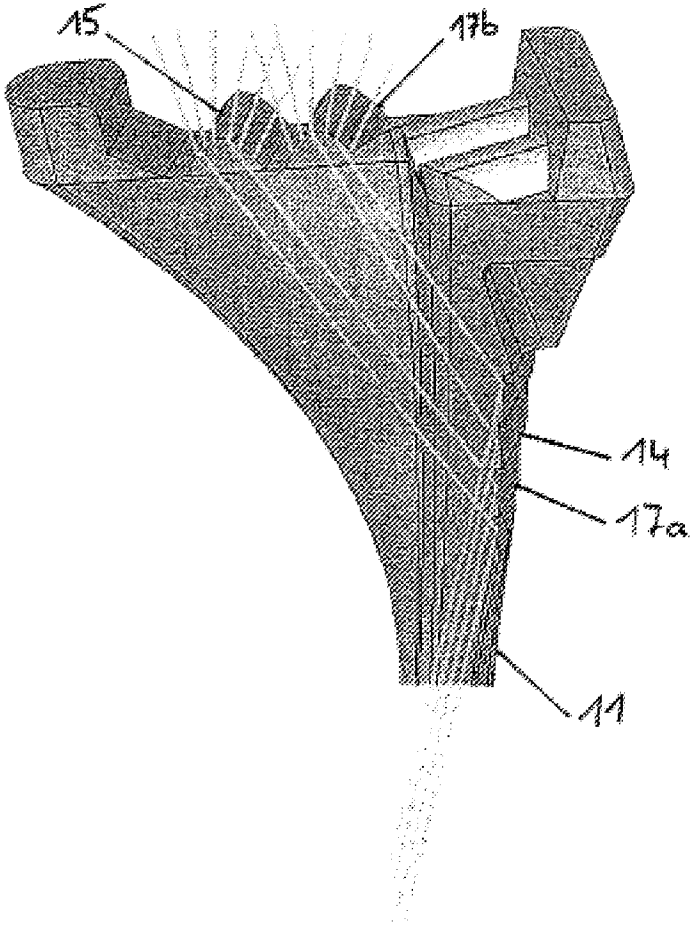
FIG. 6 illustrates the optical path through the end of the optical waveguide that faces away from the light source.

At the ends of the optical waveguide 11 that face away from the light source 10, deflecting elements 14 with which the light beams being guided in the optical waveguide 11 can be specifically deflected are arranged at a boundary surface 7 of the optical waveguide 11. Then, the deflecting elements 14 are configured in the form of surface elements 40 that are arranged at an angle that differs from that of the boundary surface 7 of the optical waveguide 11 surrounding same. The surface elements 40 are arranged in clusters 17, 17*a*, 17*b*, wherein the light beams in the optical waveguide 11 are deflected, as depicted in FIG. 6, at the deflecting elements 14 of a first cluster 17*a* so as to be focused onto the deflecting elements 15 of a second cluster 17*b*. This enables a specific distribution of light, thus making it possible to achieve an especially uniform illumination from the light emission surfaces 12, 13, 38, 39. The deflecting elements 15 on the light emission surfaces 38, 39 are configured in the form of partially circular elevations, thus enabling a wider emission angle of the light exiting from these deflecting elements 15.

Figure 3:
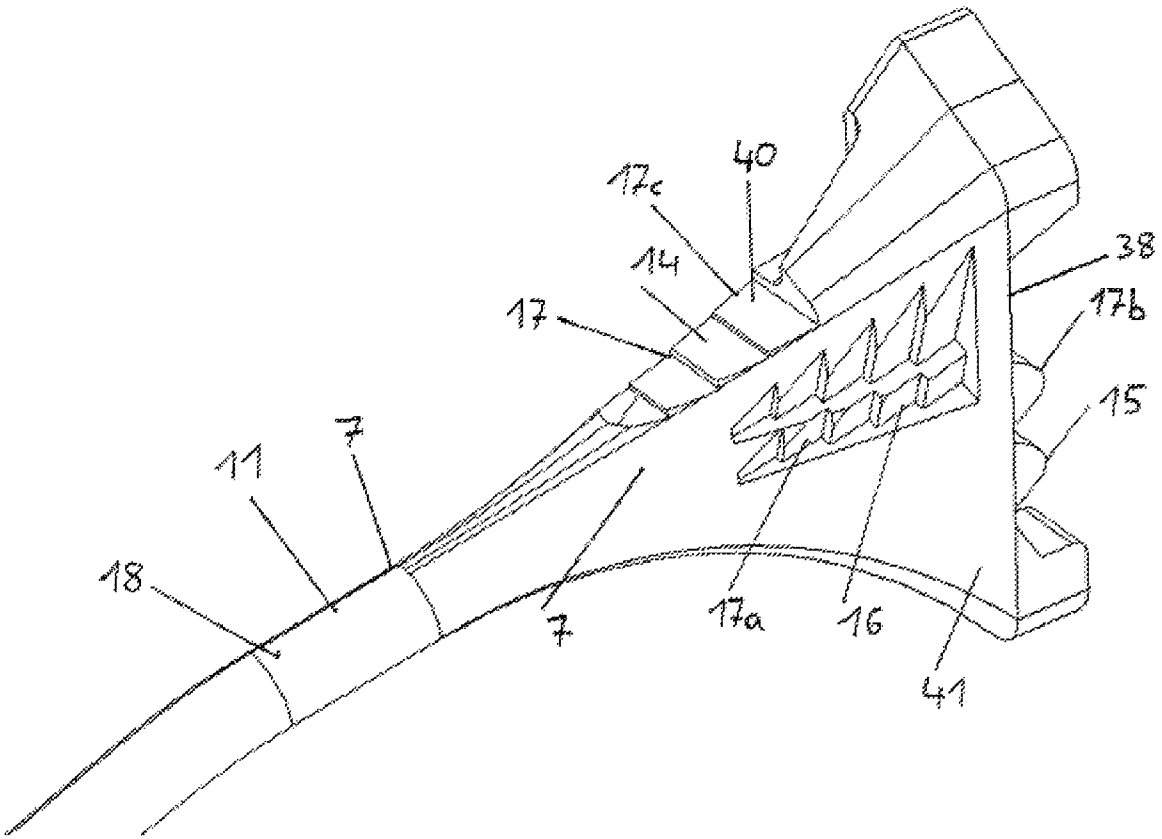
FIG. 3 illustrates a detail view of the end of the optical waveguide facing away from the light source.

FIG. 3 illustrates an enlarged representation of a branch 18 of such an optical waveguide 11. The branch 18 has a funnel-shaped expansion 41 at the end thereof that faces away from the light source 10. The funnel shape causes the light emission surface 38 to be larger than the light entry surface 22, as a result of which the light is distributed to a larger emission surface. This makes it possible to create a greater illuminating surface, to make it easier to identify the push button 3 or the insertion slot 4. In the region of the funnel-shaped expansion 41, deflecting elements 14, 16 are configured at the boundary surfaces 7 of the optical waveguide. The deflecting elements 14, 16 are then arranged in clusters 17, 17*a*, 17*c*, wherein the deflecting elements 16 are arranged in a wedge shape within the first cluster 17*a*. The deflecting elements 14 of another cluster 17*c* are arranged in the shape of a stair, wherein a stair that has four or more steps is constituted of four successively arranged surface elements 40. Light beams that are incident on the optical waveguide 11 are deflected at the deflecting elements 14, 16 and focused onto the light emission surface 38, in particular, onto deflecting elements 15 arranged on the light emission surface 38 in another cluster 17*b*.

Figure 4:
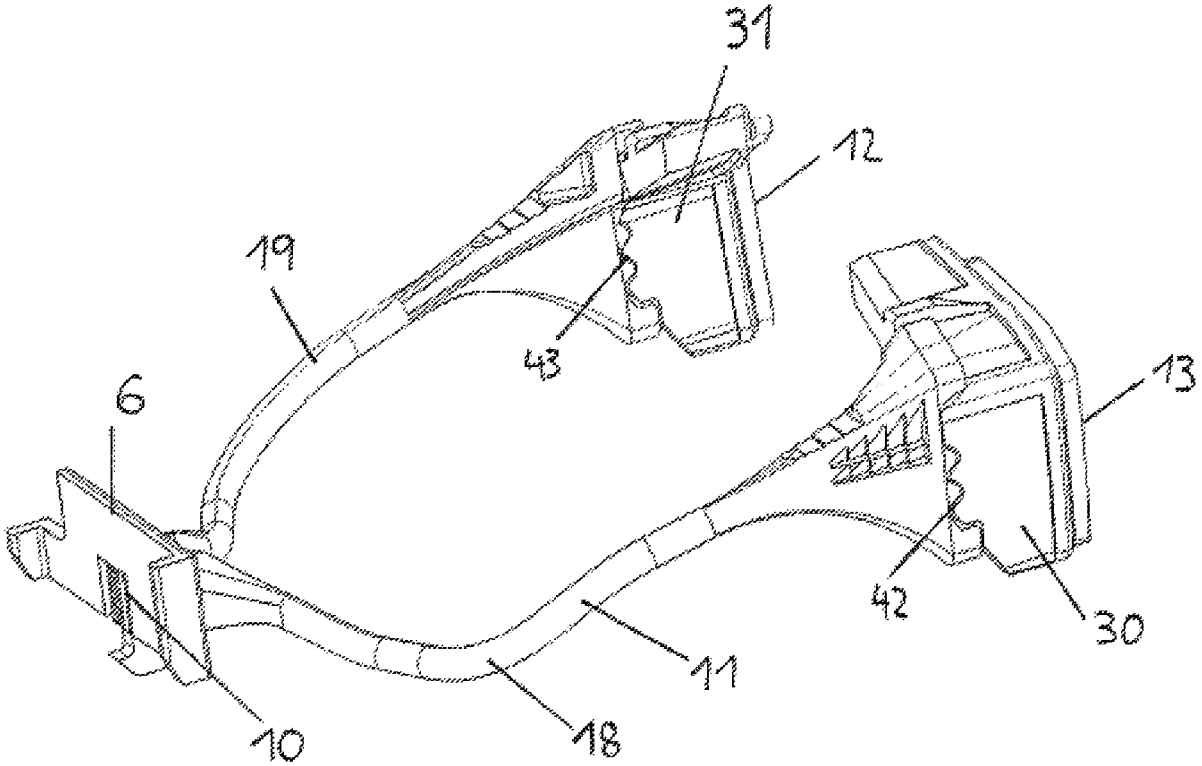
FIG. 4 illustrates an optical waveguide that is coupled at the ends thereof that face away from the light source to two light emission elements.
Figure 5:
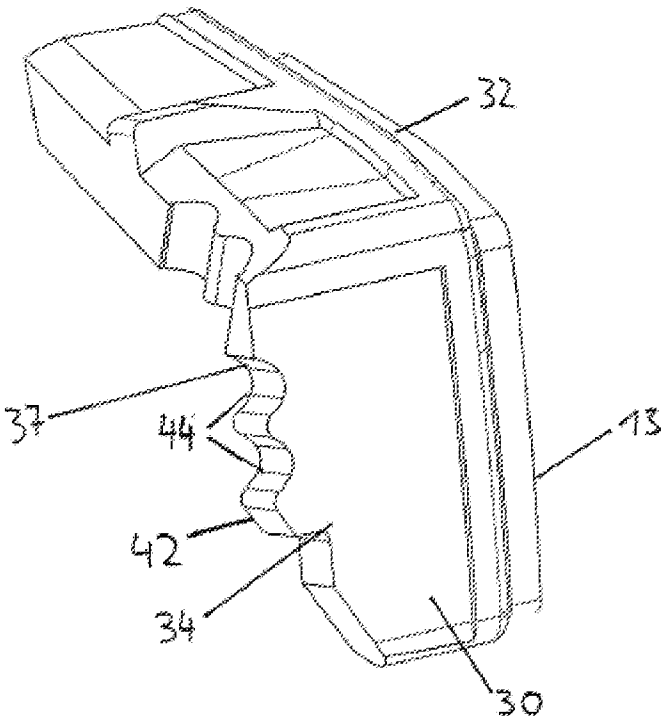
FIG. 5 illustrates a detail view of a light emission element.

FIG. 4 depicts the optical waveguide 11 with light emission elements 30, 31 that have each been placed on the ends of the optical waveguide 11 facing away from the light source 10. The light emission elements 30, 31 have light emission surfaces 12, 13 that have been adapted in shape and size to the slots 26, 27 in the housing 2, in order to enable more secure fastening of the light emission bodies 30, 31 to the housing 2. It is then provided that the light emission surfaces 12, 13 of the light emission bodies 30, 31 are flush with the end surface 5 of the housing 2, in order to prevent damage to the light emission elements 12, 13 when a belt latch is inserted into the insertion slot 4. Indentations 44, depicted in FIG. 5, are configured on the end surfaces 42, and 43 of the light emission elements 30 and 31 that face away from the light emission surfaces 12, 13, the indentations being substantially adapted to the shape of the deflecting elements 15 so that a positive-locking connection between the branches 18 and 19 of the optical waveguide 11 and the emission elements 30 and 31 is possible. The light that is decoupled from the branches 18 and 19 can then be coupled into the emission elements 30 and 31 with as little loss as possible. The coupled-in light is deliberately scattered due to the shaping of the end surfaces 42 and 43 in the emission elements 30 and 31, so that a visually high-quality and uniform appearance can be brought about. In addition, latching lugs with which the emission elements 30, 31 can be latched onto the optical waveguide 11 may be provided on the funnel-shaped extensions 41 or on the emission elements 30 and 31.

FIG. 5 illustrates a detail view of the emission element 30. The light emission element 30 has a coupling-in section 34 having a light entry surface 37. The light emission element 30 can be coupled onto the optical waveguide 11 via the transparent, light-transmissive coupling-in section 34.

Figure 7:
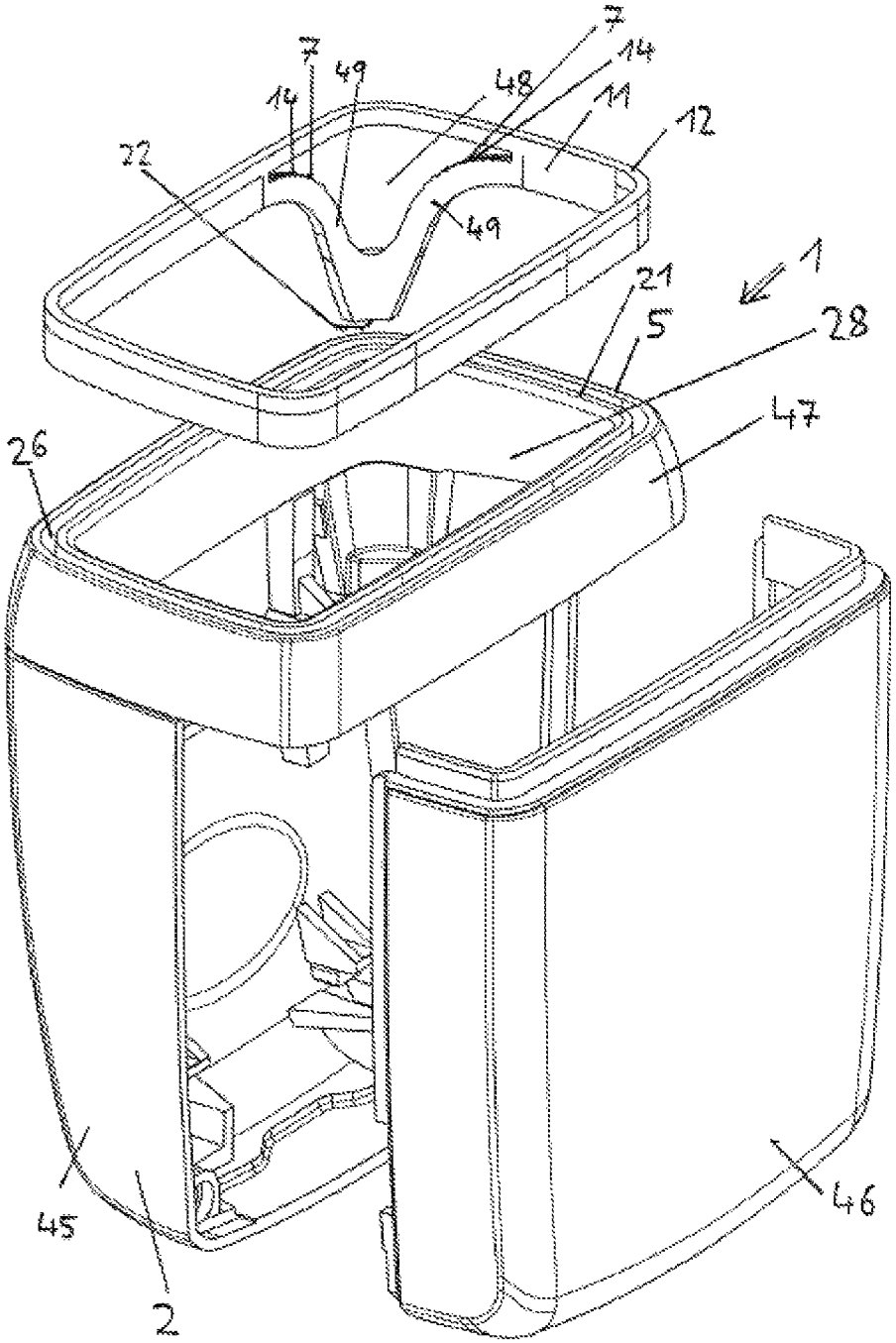
FIG. 7 illustrates an alternative housing for an illuminated belt buckle.

FIG. 7 illustrates a partial exploded view of an alternative embodiment of an illuminated belt buckle 1. The illuminated belt buckle has a housing 2 that includes a first housing half 45, a second housing half 46, and a cover 47. The cover encloses a push button 3 (not shown), as well as an insertion slot 4 for the belt latch of a seat belt, these being arranged in an opening 28 of the cover 47. In an end surface 5 of the cover 47, a slot 26 for accommodating an optical waveguide 11 having a light emission surface 12 is configured, wherein the slot 26 is preferably configured so as to be so deep that the light emission surface 12 is flush with the end face 5 of the cover 47. The light emission surface 12 is configured as a surrounding light emission surface that covers the opening 28 in the cover 47. An edge section 21 is formed on the cover 47, between the opening 28 and the slot 26.

Figure 8:
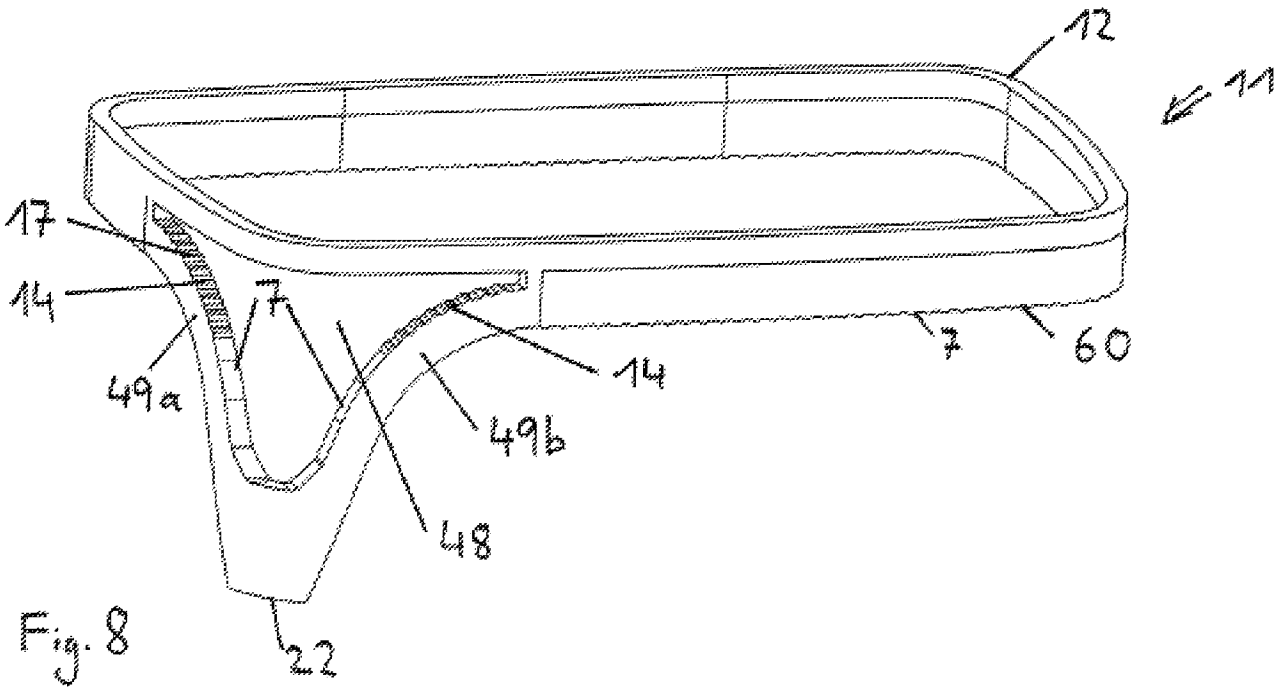
FIG. 8 illustrates an alternative optical waveguide having a surrounding light emission surface.

The optical waveguide 11 has a light entry surface 22 that is oriented substantially parallel to the light emission surface 12. The optical waveguide 11 furthermore includes an indentation 48 that divides the optical waveguide 11 into two branches 49. Deflecting elements 14 are arranged on the branches 49, at the side facing away from the light entry surface 22, the deflecting elements being configured as surface elements 40 and being arranged at a different angle from the boundary surface 7 that surrounds the surface elements 40. Therein, the deflecting elements 14 are arranged in a stair-shaped or wedge-shaped manner in a cluster 17. The branches 49 of the optical waveguide 11 open in parallel to the light emission surface 12 into the surrounding section of the optical waveguide 11, so that uniform illumination along the surrounding light emission surface 12 is achieved. FIG. 8 illustrates a detailed representation of the optical waveguide 11. FIGS. 7 and 8 show that the light entry surface 22 lies in a corner of the optical waveguide 11, and that the light is coupled in at the end of the branches 49 into the surrounding section of the optical waveguide 11. The branches 49*a*, 49*b* are then arranged so as to be turned 90° relative to one another, in order to follow the surrounding contour of the optical waveguide 11. Interference elements 60 that make it possible to reflect light beams in the direction of the light emission surface 12 are arranged on the boundary surface 7 of the optical waveguide 11 that lies opposite the light emission surface 12. This provides brighter and more uniform illumination of the light emission surface 12.

Figure 9:
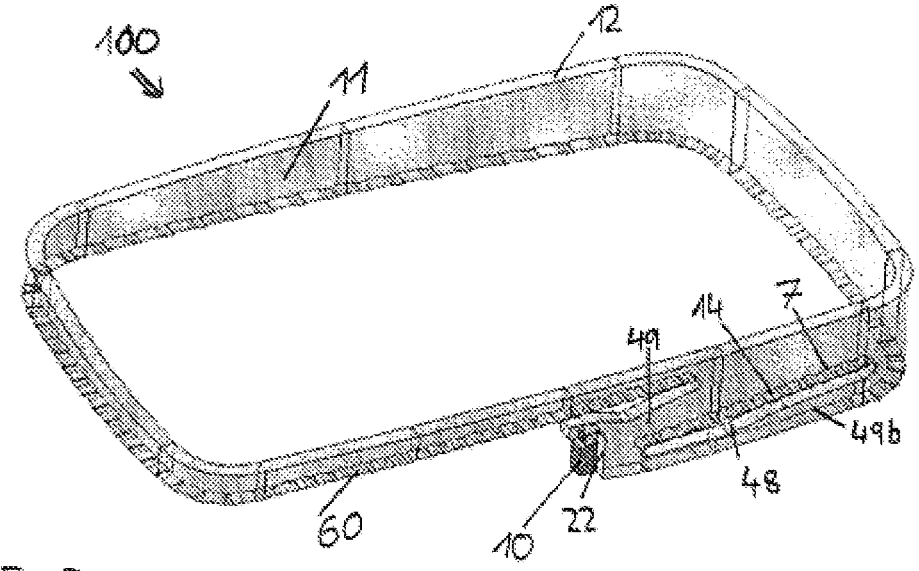
FIG. 9 illustrates another alternative optical waveguide having a surrounding light emission surface.

FIG. 9 illustrates an alternative embodiment of an optical waveguide 11 having a continuously surrounding light emission surface 12. There is then provided a light source 10 that is attached laterally at the optical waveguide 11, wherein a light entry surface 22 of the optical waveguide 11 is arranged substantially perpendicular to the light emission surface 12. From the light entry surface 22, the optical waveguide 11 has a main branch 49 and a minor branch 49*b*, via which the light of the light source 10 is coupled in into the surrounding region of the optical waveguide 11. Deflecting elements 14 via which the light beams are deflected in the direction of the light emission surface 12 are provided at an indentation 48, which constitutes a boundary surface 7 of the optical waveguide 11. Interference elements 60 that make it possible to reflect light beams in the direction of the light emission surface 12 are arranged on the boundary surface 7 of the optical waveguide 11 that lies opposite the light emission surface 12. Lateral arrangement of the light source enables a compact structure, so that the optical waveguide need not be passed through the complete housing 2 of the illuminated belt buckle 1, but can be integrated into the cover 47. The optical waveguide 11 and the light source 10 are then arranged in the surrounding slot 26, so that no further processing of the housing 2 is needed. The light source 10 is preferably configured as an LED, because LEDs allow for a relatively high light yield even when in a very compact design. The compact design is advantageous in order to be able to position the light source 10 together with the optical waveguide 11 in the slot 26 of the cover 47. The optical waveguide 11 and the light source 10 may be configured as a pre-assembled assembly 100, thus making it easier to place the assembly in the housing 2, in particular, in the cover 47. The assembly 100 may be electrically contacted via conductor paths incorporated into the housing, thus allowing for a space to be conserved when the assembly 100 is contacted.

Figure 10:
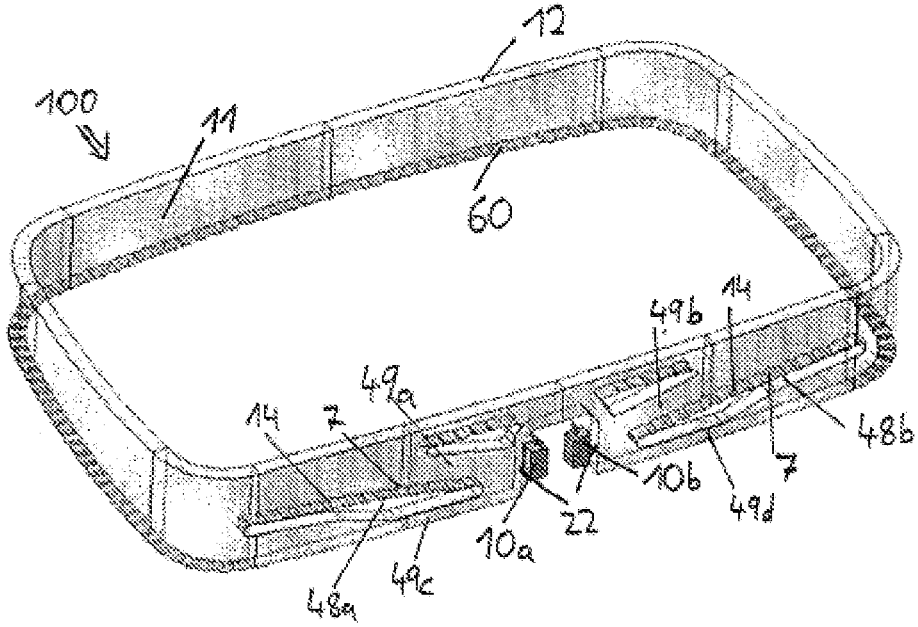
FIG. 10 illustrates another variant of an optical waveguide having a surrounding light emission surface.

FIG. 10 illustrates another alternative embodiment of an optical waveguide 11 for an illuminated belt buckle 1 according to the invention. In substantially the same structure as described in FIG. 9, two light sources 10*a*, 10*b* that can each be coupled to the optical waveguide 11 via a light entry surface 22 are provided. In the extension of each of the light entry surfaces 22, the optical waveguide 11 has a main branch 49*a*, 49*b* and a minor branch 49*c*, 49*d*, respectively, via which the light is redirected in the direction of the surrounding section of the optical waveguide 11. The main branch 49*a*, 49*b* and the minor branch 49*c*, 49*d* are separated from one another by an indentation 48*a*, 48*b*, respectively, wherein deflecting elements 14 are provided at the boundary surfaces of the optical waveguide 11 to the respective indentation 48*a*, 48*b*, in order to deflect the light in the direction of the light emission surface 12. Interference elements 60 that make it possible to reflect light beams in the direction of the light emission surface 12 are arranged on the boundary surface 7 of the optical waveguide 11 that lies opposite the light emission surface 12. This optical waveguide 11, too, is configured so compactly as to enable integration into the slot 26 of the cover 47, thus making it possible to forgo passing the optical waveguide 11 through the housing halves 45, 46, and requiring only a flexible electrical connecting cable in order to supply current to the light sources 10*a*, 10*b*. As described for the embodiment in FIG. 9, this embodiment also allows for a pre-assembled assembly 100 made of the optical waveguide 11 and the two light sources 10*a*, 10*b*, which is placed in the housing 2 and contacted electrically accordingly.

While the above description constitutes the preferred embodiment of the present invention, it will be appreciated that the invention is susceptible to modification, variation and change without departing from the proper scope and fair meaning of the accompanying claims.

The invention claimed is:

1. An illuminated belt buckle for a seat belt device for a motor vehicle, comprising, a housing, a push button that is displaceable in the housing, an insertion slot for inserting a belt latch that can be locked in the belt buckle, the insertion slot bounded by an edge section of the housing, at least one light source, at least two light emission surfaces that are arranged at different, opposite edge sides of the push button wherein the light source and the at least one light emission surface are connected via at least one optical waveguide, the optical waveguide includes a light entry surface associated with the light source and two separate light emission surfaces, wherein the optical waveguide branches from the light entry surface into two separate branches, wherein each one of the two separate light emission surfaces is associated with one of the two separate branches, a deflecting element arranged or formed on at least one boundary surface end of the two separate branches of the optical waveguide or on at least one boundary surface of each of the two separate light emission surfaces, the deflecting element having a geometry that differs from the rest of the boundary surface of the optical waveguide or the light emission surface.

2. The illuminated belt buckle according to claim 1 further comprising, the deflecting element protrudes out or is recessed relative to the rest of the boundary surface of the optical waveguide or the light emission surface.

3. The illuminated belt buckle according to claim 1 further comprising, the deflecting element is arranged or formed at an angle that differs from the rest of the boundary surface of the optical waveguide or the light emission surface.

4. The illuminated belt buckle according to claim 1 further comprising, a plurality of the deflecting elements are provided on at least one of the boundary surfaces of the optical waveguide or the light emission surface.

5. The illuminated belt buckle according to claim 1 further comprising, a plurality of identical or similar of the deflecting elements are combined in a cluster of the optical waveguide or the light emission surface.

6. The illuminated belt buckle according to claim 5, further comprising, a plurality of the clusters of the deflecting elements are present on the boundary surfaces of the optical waveguide or the light emission surface.

7. The illuminated belt buckle according to claim 1 further comprising, the deflecting elements are wedge-shaped or stair-shaped.

8. The illuminated belt buckle according to claim 1 further comprising, the deflecting elements are configured as partially circular elevations.

9. The illuminated belt buckle according to claim 1 further comprising, the light emission surface has a linear contour, having a shape adapted to a shaping of an edge side of the push button that is arranged laterally in a direction of view toward the insertion slot.

10. The illuminated belt buckle according to claim 1 further comprising, the light emission surface is constituted of a surrounding light emission surface at an end face of the housing.

11. The illuminated belt buckle according to claim 10, further comprising, the light emission surface is configured as a band that continuously surrounds the push button.

12. The illuminated belt buckle according to claim 1 further comprising, the push button is arranged in an end face of the housing, and the optical waveguide has geometric interference at a side thereof that faces away from the end face.

13. The illuminated belt buckle according to claim 1 further comprising, the light emission surface is configured as surrounding an opening in the housing which includes the insertion slot, the optical waveguide integrated into the light emission surface and the light entry surface lies in a corner of the optical waveguide and light is coupled in at the end of the two branches of the optical waveguide.

14. The illuminated belt buckle according to claim 1 further comprising, the light emission surface is configured as continuously surrounding an opening in the cover which includes the insertion slot, with the light entry surface arranged substantially perpendicular to the light emission surface.

15. The illuminated belt buckle according to claim 1 further comprising, the light emission surface is configured as continuously surrounding an opening in the housing which includes the insertion slot, a pair of the light sources with a corresponding pair of the light entry surfaces arranged substantially perpendicular to the light emission surface.

16. The illuminated belt buckle according to claim 1 further comprising, each of the two branches of the optical waveguide terminate at a first of the light emission surfaces which is closely positioned with a light entry surface of a light emission element, the light emission element forming a second of the light emission surfaces.

17. The illuminated belt buckle according to claim 16 further comprising the light emission element formed of a funnel shape such that it enlarges from the light entry surface to the second of the light emission surfaces.

18. An illuminated belt buckle for a seat belt device for a motor vehicle, comprising, a housing, a push button that is displaceable in the housing, an insertion slot for inserting a belt latch that can be locked in the belt buckle, the insertion slot bounded by an edge section of the housing, at least one light source, at least one light emission surface, wherein the light source and the at least one light emission surface are connected via at least one optical waveguide, a deflecting element arranged or formed on at least one boundary surface of the optical waveguide or on at least one boundary surface of the light emission surface, the deflecting element having a geometry that differs from the rest of the boundary surface of the optical waveguide or the light emission surface further comprising, a plurality of identical or similar of the deflecting elements are combined in a cluster of the optical waveguide or the light emission surface and a plurality of the clusters of the deflecting elements are present on the boundary surfaces of the optical waveguide or the light emission surface, at least two of the clusters are arranged in such a manner that a plurality of light beams guided through the optical waveguide are deflected at a first cluster and aligned at a second cluster.

* * * * *